US007404471B2

(12) United States Patent
Felder et al.

(10) Patent No.: US 7,404,471 B2
(45) Date of Patent: Jul. 29, 2008

(54) PUSH BUTTON FOR ELEVATOR CAR OPERATING PANEL

(75) Inventors: Hugo Felder, Buchrain (CH); Dennys Taiana, Losone (CH)

(73) Assignee: Inventio AG, Hergiswil NW. (CH)

( * ) Notice: Subject to any disclaimer, the term of this patent is extended or adjusted under 35 U.S.C. 154(b) by 490 days.

(21) Appl. No.: 11/128,785

(22) Filed: May 13, 2005

(65) Prior Publication Data

US 2005/0252725 A1 Nov. 17, 2005

(30) Foreign Application Priority Data

May 17, 2004 (EP) ..... 04405310

(51) Int. Cl.
*B66B 1/34* (2006.01)

(52) U.S. Cl. ..... 187/395; 187/414

(58) Field of Classification Search ..... 187/391–398, 187/414

See application file for complete search history.

(56) References Cited

U.S. PATENT DOCUMENTS 5,454,448 A * 10/1995 Bittar et al. ..... 187/395
5,507,366 A * 4/1996 Huang ..... 187/395
5,679,934 A 10/1997 Juntunen et al.
5,969,306 A * 10/1999 Velauthapillai et al. ..... 187/395
6,161,655 A * 12/2000 Lejon et al. ..... 187/392
6,227,335 B1 * 5/2001 Koeppe et al. ..... 187/414
6,502,668 B1 * 1/2003 Chida et al. ..... 187/395
7,021,428 B2 * 4/2006 Han et al. ..... 187/395

FOREIGN PATENT DOCUMENTS

| | | |
|---|---|---|
| DE | 19744791 A | 4/1999 |
| EP | 1187156 | 3/2002 |
| EP | 1386875 A | 2/2004 |
| FR | 2797858 A | 3/2001 |
| GB | 2382291 | 5/2003 |

* cited by examiner

*Primary Examiner*—Jonathan Salata
(74) *Attorney, Agent, or Firm*—Fraser Clemens Martin & Miller LLC; William J. Clemens

(57) ABSTRACT

An elevator car operating panel includes a plurality of push buttons corresponding to floors of a building, wherein the push buttons act on a touch screen to register elevator calls. The push buttons are mounted on an outer surface of the touch screen at locations corresponding to sensors behind the touch screen. A method to modernize and/or update a touch screen elevator car operating panel includes mounting at least one push button on a touch screen to act on the touch screen to register elevator calls.

11 Claims, 1 Drawing Sheet

PUSH BUTTON FOR ELEVATOR CAR OPERATING PANEL

BACKGROUND OF THE INVENTION

The present invention concerns an elevator with a car operating panel to register elevator calls, push buttons for an elevator car operating panel and a method to change, respectively modernize, a touch screen elevator car operating panel.

In the new generations of inexpensive elevators for small buildings, there was introduced the concept of a car operating panel with a keypad exhibiting ten digits (0 to 9). This decade-keypad system has reached the target of a unique factory produced car operating panel for all elevators, with evident cost and logistic advantages.

As an added feature, due to the presence of a decade-keypad and several displays, the car panel could also be used as a maintenance tool.

These car operating panels are often based on the touch screen principle. Behind a flat touch screen of steel, aluminum or glass, sensors are located, which generate an electromagnetic field. When this field is disturbed by the touch of a finger, this touch is detected and an elevator call is placed through the electronics of a printed circuit board.

The advantage of this technology is that no displaceable part is necessary to place an elevator call and a closed front screen can be used as an interface with the passenger, which exhibits no opening, through which liquids or dirt could penetrate. These screens are furthermore easy to clean and safe in respect of vandalism.

A disadvantage of these car operating panels consisting in a touch screen is, however, that they do not conform to the standards concerning handicapped people, in particular those prescribed for elevator installations.

If a handicapped or blind person touches the elevator touch screen, an elevator call is placed without the will of that person and without the perception of that person that an elevator call has been actually placed.

According to the standards EN 81-70 and ISO/DIS 4190-5 (draft), these requirements must be fulfilled for the elevator push buttons of a car operating panel: an operating force between 2.5 and 5 N, an operating and registration feedback and floor numbers in relief with a minimal height of 0.8 mm.

In the field of elevators it is in particular often required to update or modernize elevator car operating panels, so that they conform to standards concerning handicapped people, when, for example, the use of a building is changed and some parts of the building become open to public access. Normally this problem is solved by demounting the touch screen car operating panel and mounting another mechanical car operating panel based on the principle of the conventional push buttons. Several cables and printed circuits must be de-installed and newly connected during these time-consuming operations.

It is desirable therefore to develop a method and an apparatus to modernize a touch screen car operating panel, which can make it conform to the standards concerning handicapped people and which is practical, inexpensive and fast.

Accordingly, it is an object of the present invention to provide a car operating panel for an elevator installation which conforms to the standards concerning handicapped people, and to provide an apparatus and a method to modernize a touch screen car operating panel, in order to make it conform to the standards concerning handicapped people, which is easy, fast and inexpensive.

SUMMARY OF THE INVENTION

The present invention concerns a car operating panel that solves this problem and which comprises push buttons corresponding to floors of a building, wherein the push buttons act on a touch screen to register elevator calls.

The push buttons are displaceable parts of the car operating panels, and can place an elevator call, when pushed for example by the human finger of an elevator user, by the effect of their own displacement produced by an acting force applied on them.

They place a call by acting on a touch screen, which by definition generates and transmits the call signal to the elevator control without the need of a physical displacement or the effect of an applied force.

The present invention exhibits the advantage that the push buttons can be de-mounted or mounted on the touch screen, making a touch screen car operating panel conform to the to standards concerning handicapped people in an easy, fast and inexpensive way. This car operating panel can be freely configured and modernized according to the standards in a very user-friendly way, without the need of expensive components or complex operations. An existing touch screen must not be demounted and a new mechanical car operating panel must not be mounted, in order to fulfill the standards. This car operating panel is easily convertible and polyvalent. According to the need of the customer, a touch screen solution or a push button solution can be provided and adapted.

Since the configuration is carried out only by de-mounting or mounting push buttons of the car operating panel on the touch screen, the operation can be carried out in a very fast, elegant and time non-consuming way. Additional mechanical or electrical components, such as cables, printed circuits or connectors are not required.

Additional advantages are that the touch screen underlying the push buttons is characterized by a long life duration, is resistant to the penetration of liquids, and confers these advantages to the whole car operating panel including the push buttons.

The car operating panel according to the present invention comprises further a sensor on a switch contact board, which is suitable to sense through an electromagnetic field an elevator call placed on the touch screen by the touch of a human hand.

This preferred embodiment exhibits the advantage, that the touch screen can place elevator calls with a high and adjustable sensitivity.

Also, the car operating panel according to the present invention comprises a frame surrounding the push button and an elastic element suitable to reset the push button position after having placed an elevator call.

This preferred embodiment exhibits the advantages, that the push button is easily mounted on the touch screen through the frame and that after the displacement due to a call placement, the push button is reset in its initial position in a reliable, fast and practical way.

The push buttons are provided with Braille signs in relief indicating the floors assigned to the buttons, in such a way that they are recognizable by a blind person.

This embodiment exhibits the advantage that the elevator installation is made compatible with the standards relating to handicapped people and that blind persons not only can realize through a mechanical feedback, that an elevator call has been placed, but also can be made aware of which floor each push button corresponds.

The push buttons are configured to place an elevator call on the touch screen, when the push force lies between 2.5 and 5 Pa.

This embodiment exhibits the advantage that the operation force of the push buttons lies in a range easily reached by the human finger.

The push buttons are configured to give an operating feedback by their displacement.

This embodiment exhibits the advantage that an operation feedback of the push buttons is achieved, which is particularly important for handicapped people.

The push buttons are mountable on a touch screen of the elevator car operating panel.

This embodiment exhibits the advantage that a pre-existing touch screen operating panel can be upgraded or updated in a practical, fast and inexpensive way to a mechanical car operating panel conform to the standards for handicapped people by mounting the push buttons on the touch screen.

The push buttons are mountable on the touch screen of the elevator car operating panel by snap action and/or by screws and/or by gluing.

This embodiment exhibits the advantage that a pre-existing touch screen operating panel can be upgraded or updated in a practical, fast and inexpensive way to a mechanical car operating panel conform to the standards for handicapped people by mounting the push buttons on the touch screen with conventional, inexpensive and easily adaptable connecting means.

An adapter for an elevator car operating panel is provided, comprising a plurality of push buttons.

This embodiment exhibits the advantage that the push buttons are assembled together in an adapter having the function of a modernization frame or mask, so that the modernization and installation operation is made easier, more rapid and robust.

A method to change or modernize a touch screen elevator car operating panel is provided according to the present invention, wherein push buttons are mounted on the touch screen, which are configured to act on the touch screen to register elevator calls.

This embodiment exhibits the advantage that the change or modernization of a touch screen car operating panel in a mechanical car operating panel conform to the standards is made easier, faster and less expensive by simply mounting push buttons on the touch screen.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
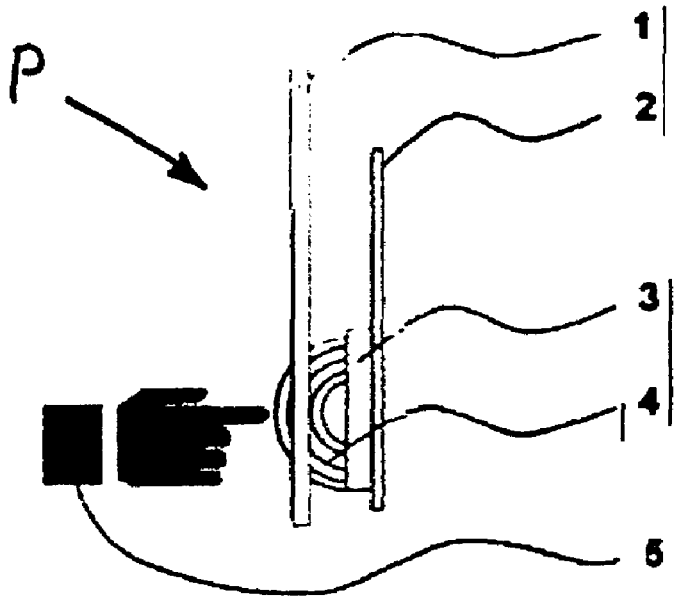
FIG. 1 (PRIOR ART)
FIG. 1 is a schematic representation of a prior art touch screen car operating panel, according to a conventional embodiment.

FIG. 1 shows a prior art known touch screen car operating panel P.

The car operating panel P exhibits a keypad, which is typically characterized by ten digits (0 to 9) arranged in a predefined spatial order (decade-keypad). The buttons could also just be arranged in a traditional way (–1, 0, 1, 2, 3 . . . ). The keypad exhibits touch sensitive buttons, which are used to place elevator calls to the building floors. The floors corresponding to the touch buttons are indicated by contrasted markings indelibly stamped and visible on the keypad surface area. Capacitive sensors arranged behind the areas corresponding to the sensitive touch buttons produce an electromagnetic field, which is disturbed by the touching of a human finger. In this way, the car operating panel P can detect elevator calls placed by a user and transmit them to the elevator control.

In FIG. 1, behind a flat touch screen 1 formed of steel, aluminum or glass, sensors 3 are located, which generate an electromagnetic field 4. When this field 4 is disturbed by the touch of a finger of a human hand 5, this touch is detected and an elevator call is placed through the electronics of a switch contact board 2.

The advantage of such a car operating panel P is that no displaceable part is necessary to place an elevator call, a closed front screen can be used as an interface with the passenger, which exhibits no opening, through which liquids or dirt could penetrate. These screens 1 are furthermore easy to clean and safe in respect of vandalism.

A disadvantage of this car operating panel P using a touch screen is, however, that it does not conform to the standards concerning handicapped people, in particular those prescribed for elevator installations.

If a handicapped or blind person touches the elevator touch screen 1, an elevator call is placed without the will of that person and without the perception of that person, that an elevator call has been actually placed.

It is often necessary in elevator applications to upgrade, update or modernize a touch screen car operating panel, such that presented in FIG. 1, in order to make it conform to the standards for handicapped people. A conversion must be carried out to a mechanical push button car operating panel.

Figure 2:
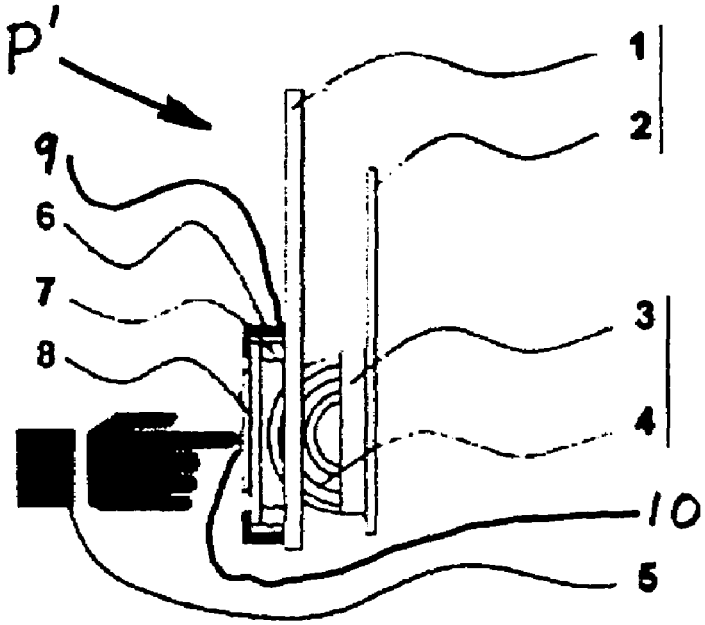
FIG. 2 is a schematic representation of a car operating panel, according to the preferred embodiment of the present invention.

FIG. 2 shows a preferred embodiment of the present invention, which solves the cited problem.

A car operating panel P' has a push button 7 mounted on the front surface of the touch screen 1 by fastening means 9 such as by snapping or by screws or by gluing. The push button 7 comprises a displaceable central part used to place an elevator call and a frame 6 surrounding the central part, which is used for the mounting operations. The push button 7 further comprises an elastic element 8, such as a membrane, onto which the force of a finger of the human hand 5 can be applied producing a displacement and which is suitable to reset the position of the push button after having placed an elevator call.

The elastic element 8 can be simply an elastic membrane, which is displaced towards the touch screen, as soon as it is touched by a human finger. The elastic element can alternatively have a rigid pressure area, onto which the pressure of a finger is applied. Said pressure area is connected to the touch screen 1 through a spring element, which is suitable to reset the position of the push button 7 after having placed an elevator call.

Such push buttons 7 act on the touch screen 1 to register elevator calls. When the finger of the hand 5 pushes the push button 7, the elastic element 8, for example in the form of a membrane, is displaced by the force applied by the finger and disturbs the electromagnetic field 4 created by the sensor 3. An elevator call is consequently detected and placed through the switch contact board 2. When the force applied by the finger 5 is released, the elastic membrane 8 resets the push button into its original position.

If the elastic element 8 includes a pressure area connected to a spring element, the spring element resets the push button 7 into its original position.

The electromagnetic field 4 created by the sensor 3 is disturbed only if a certain minimum predetermined force is applied by the finger 5 to the membrane 8. In this case an elevator call is placed. If the membrane 8 is only touched, but no force is exerted on it, no elevator call is placed. For example, the touching of the membrane 8 by a blind man looking for the right push-button does not lead to the placing of an elevator call.

In case of public buildings, in which elevator installations must meet standards relating to handicapped people, the push buttons 7 can exhibit Braille signs 10 in relief indicating the floors assigned to the buttons, in such a way that they are recognizable also by a blind person. An operating force between 2.5 and 5 N, an operating and registration feedback and floor numbers in relief with a minimal height of 0.8 mm are also compulsory requirements. The operating feedback is given by the displacement of the elastic element 8, in the preferred embodiment of the present invention.

The push buttons 7 can be mounted singularly onto the touch screen 1 or can be assembled together in an adapter. The adapter is successively mounted on the touch screen 1 in the form of a mask, in order to make the car operating panel P' compatible with the standards for handicapped people.

The push buttons 7 of the keypad, which correspond to floors which are present in the building, can be for example snapped singularly onto the touch screen 1 by means of the snap-in push button frame 6. The push button 7 comprises then a movable central part, which is used to place elevator calls, and the external frame part 6, which is fixed and is used to snap the push buttons on the touch screen 1. The push buttons 7 are therefore easily installable, configurable and replaceable.

But it is also possible to snap onto the touch screen 1 a whole adapter containing several push buttons. In this case, the adapter must be prepared to correspond to the touch screen onto which it must be mounted. Furthermore, the snap-in frame will be in this case a frame for the whole adapter and not for each single push button.

The keypad exhibits finally push buttons, which are used to place elevator calls to the building floors by the effect of a mechanical displacement and not by the effect of the disturbance of an electromagnetic field, as in the case of the pre-existing touch screen.

The push buttons are movable in the horizontal direction in order to place the calls and can be firmly mounted onto the touch screen 1 also by means of gluing, screwing or welding. They act directly on the touch screen 1, in order to place the elevator calls. The frame 6 surrounds preferably the push buttons, which can be firmly fixed to the touch screen 1 of the car operating panel P' by means of gluing, screwing or welding. The floors corresponding to the push buttons are indicated by contrast markings indelibly stamped or laser-printed on the push buttons. The switch contacts are arranged behind the touch screen 1 in correspondence to the push buttons to produce an electrical signal, which is then generated by the touching of a human finger. In this way, the car operating panel P' can detect elevator calls placed by a user and transmit them to the elevator control.

Such a car operating panel is therefore freely convertible from a touch screen panel to a mechanical push button panel and vice versa and can be customized to the building and to the standards in a very user-friendly and inexpensive way.

The push button corresponding to a predetermined floor must be so positioned on the touch screen 1, that the digit marked on it corresponds to the floor, for which the switch contact under the touch screen has been enabled by the elevator control to place a call.

Note that the conversion operations are very simple and do not require any special electronic equipment or software programs to be executed. The conversion can be carried out manually by any person in a very fast, user-friendly and inexpensive way by using well-established factory produced components.

With this concept, the car panel can be converted directly in the field without the need of a factory customization.

Thanks to the present invention, kits of elevator push buttons can be produced and sold independently from the fabrication and installation of an elevator. These kits can be provided to maintenance personal, customers and even elevator users, so that they can personalize, upgrade, update or modernize their elevator installations corresponding to their wishes and to the standards, with no need of complex and expensive technical operations.

The push buttons 7 of the car operating panel P' shown in FIG. 2 are also configurable to correspond to elevator operations and functions to be carried out and activated during maintenance or service.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A push button for use with an elevator car operating panel having a touch screen and at least one sensor mounted behind the touch screen and corresponding to a floor of a building, the at least one sensor being responsive to the touch of a human at a front surface of the touch screen adjacent the at least one sensor for registering an elevator call for the floor, the push button comprising:

the push button having a central part responsive to application of a predetermined applied pressure; and means mounting the push button on the front surface of the touch screen adjacent the at the at least one sensor whereby when said push button central part is actuated by application of the predetermined applied pressure, an electromagnetic field generated by the at least one sensor is disturbed without said push button central part contacting the touch screen, and the at least one sensor responds by registering the elevator call for the floor.

2. The push button according to claim 1 wherein the at least one sensor is mounted on a switch contact board and senses through the electromagnetic field the touch of the human hand.

3. The push button according to claim 1 wherein said push button includes a frame surrounding a displaceable actuation area and an elastic element acting to reset said push button position after having registered the elevator call.

4. The push button according to claim 1 wherein said push button is provided with Braille signs in relief indicating the floor assigned to the button and being recognizable by a blind person.

5. The push button according to claim 1 wherein said push button is actuated to register the elevator call when a push force applied to said push button lies between 2.5 and 5 N.

6. The push button according to claim 1 wherein said push button provides an operating feedback to the human hand by its displacement under applied pressure.

7. A car operating panel of an elevator comprising:

a touch screen having a front surface;

a plurality of sensors mounted behind said touch screen each corresponding to an elevator call to be registered for an associated floor;

a plurality of push buttons each adapted to be actuated by a human finger and each corresponding to one of said sensors; and means for mounting said push buttons on said front surface of said touch screen, each said push button being mounted adjacent the corresponding one of said sensors whereby actuation of said push buttons disturbs an electromagnetic field generated by said corresponding sensor without contacting said touch screen and causes said corresponding sensor to register the elevator call for the associated floor.

8. The panel according to claim 7 wherein said means for mounting includes a frame being adapted to mount on said front surface of said touch screen by at least one of a snap action, screws and gluing.

9. The panel according to claim 7 wherein each of said push buttons includes an elastic element movable toward said front surface of said touch screen in response to force applied by the human finger.

10. The panel according to claim 7 including at least another sensor mounted behind said touch screen and corresponding to an elevator maintenance or service operation and at least another push button mounted on said front surface of said touch screen adjacent said at least another sensor whereby actuation of said at least another push button disturbs an electromagnetic field generated by said at least another sensor and causes said at least another sensor to register a request for the corresponding elevator operation.

11. The panel according to claim 7 wherein said sensors are arranged as a decade keypad.

* * * * *